US012281560B1

(12) United States Patent
Iriarte Lopez et al.

(10) Patent No.: US 12,281,560 B1
(45) Date of Patent: Apr. 22, 2025

(54) METHODS AND SYSTEMS FOR SIMULATING STAGE COMPLETION TO ASSESS TRADEOFFS BETWEEN ENERGY AND PUMPING TIME AND ALTERING SUBSEQUENT STAGE COMPLETIONS BASED ON THE SAME

(71) Applicant: Well Data Labs, Inc., Denver, CO (US)

(72) Inventors: Jessica G. Iriarte Lopez, Denver, CO (US); Samid A. Hoda, Thornton, CO (US)

(73) Assignee: Well Data Labs, Inc., Denver, CO (US)

( * ) Notice: Subject to any disclaimer, the term of this patent is extended or adjusted under 35 U.S.C. 154(b) by 602 days.

(21) Appl. No.: 17/685,965

(22) Filed: Mar. 3, 2022

Related U.S. Application Data

(60) Provisional application No. 63/156,201, filed on Mar. 3, 2021.

(51) Int. Cl.
*E21B 43/267* (2006.01)
*E21B 21/08* (2006.01)

(52) U.S. Cl.
CPC ..... *E21B 43/267* (2013.01); *E21B 21/08* (2013.01); *E21B 2200/20* (2020.05)

(58) Field of Classification Search
CPC ..... E21B 43/267; E21B 21/08; E21B 2200/20
See application file for complete search history.

(56) References Cited

U.S. PATENT DOCUMENTS 11,613,986 B1 3/2023 Iriarte Lopez et al.
2016/0252897 A1* 9/2016 Ashok ..... G05B 19/4155 700/275
2021/0406792 A1* 12/2021 Bhardwaj ..... G06N 20/20

* cited by examiner

*Primary Examiner* — Nathaniel T Woodward
(74) *Attorney, Agent, or Firm* — Derek D. Donahoe; Polsinelli PC

(57) ABSTRACT

Aspects of the present disclosure are directed to simulating the effect of altering the speed at which a well stage is hydraulically fractured to determine a trade-off between energy usage and pumping time. In one aspect, a method of simulating attributes of a stage completion includes determining a first amount of energy used for a stage completion at a first rate during a well completion process; determining a second rate for simulating the stage completion, the second rate being different than the first rate; simulating the stage completion at the second rate by determining a second amount of energy used for the stage completion at the second rate; and comparing the first amount of energy to a second amount of energy used in the stage completion to determine a trade-off between energy usage and pumping time.

20 Claims, 13 Drawing Sheets

METHODS AND SYSTEMS FOR SIMULATING STAGE COMPLETION TO ASSESS TRADEOFFS BETWEEN ENERGY AND PUMPING TIME AND ALTERING SUBSEQUENT STAGE COMPLETIONS BASED ON THE SAME

CROSS-REFERENCE TO RELATED APPLICATION

This application is related to and claims priority under 35 U.S.C. § 119 from U.S. Provisional Application No. 63/156,201 filed Mar. 3, 2021 entitled "Methods and Systems for Simulating Stage Completion to Assess Tradeoffs Between Energy and Pumping time and Altering Subsequent Stage Completions Based on the Same," the entire contents of which are fully incorporated by reference herein for all purposes.

TECHNICAL FIELD

Aspects of the present disclosure involve a system and method for simulating the speed of hydraulic fracturing of a well relative to a measurement of actual hydraulic fracturing a well to demonstrate tradeoffs between power, energy use and/or time, and the subsequent modification of parameters to optimize hydraulic fracturing of a different stage or well based on the same.

BACKGROUND AND INTRODUCTION

Hydraulic fracturing refers to the process of pumping hydraulic fracturing fluid (predominately water) under high pressure into a horizontal portion of a well where the high-pressure water fractures the formation surrounding the well bore to release the natural resources (e.g., oil or gas) trapped in the surrounding formation. The horizontal portion of the wellbore can be thousands of feet and is typically subdivided into discrete stages that are separately hydraulically fractured. Hydraulically fracturing a well can take several days depending, at least in part, on how many stages are being completed.

It is with these observations in mind, among others, that aspects of the disclosure were conceived.

SUMMARY

Aspects of the present disclosure involve a method and system for simulating the effect of altering the speed at which a stage is hydraulically fractured. The "speed" for hydraulic fracturing a stage is governed, at least in part, by the rate at which the fracturing fluid pumps are run. There is a tradeoff between the power/energy used by the pumps at different rates to speed up the process and there are also various limits at which hydraulic fracturing can or should occur. In one example, the simulation involves producing information about altering parameters (e.g., speed) of the hydraulic fracturing process and deriving information about energy/power consumption if the process were run at the simulated rates. In many instances, a simulation may be run against a stage of a well, and the information from the simulation may be used to alter the respective parameters of a different stage in the same well. Alternatively, or additionally, the information from a simulation run against a stage of a well may be used to alter parameters for a different well, which is particularly informative when the well is through the same formation as the well (or stage) data used for the simulation.

The process of simulating the effect of altering the rate of fracturing operations may be such that a rate for altering (e.g., speeding up) a stage completion is determined (may be referred to as a speed-up rate) after data and channel calibrations, identification of a target rate of fluid injection (e.g., in barrels per minute (BPM)) and a time to achieve the target rate. This speed-up rate may be used to simulate a faster stage completion (relative to some base rate or the rate at which the well was actually hydraulically fractured). A pressure-rate relationship is then estimated, and the simulation is carried out using the pressure-rate relationship and the speed-up rate. Based on the results, a hydraulic horsepower (energy used) for the simulated job is compared to the hydraulic horsepower for completing the job at the typical or designed rate and for the typical or designed amount of pumping time. Accordingly, effects of speeding up a stage completion on energy usage and pumping time can be determined. In one example and as a post-processing step, the simulation results are examined to determine and identify regions where potential operation constraints are violated due to the speed up. The results may then be presented on a terminal to operators and analyst for review and/or further processing, and the results may also be accessed by a system for further processing and from which completion plans and hydraulic fracturing operations may be determined and altered.

In one aspect, a method of simulating attributes of a stage completion includes determining a first amount of energy used for a stage completion at a first rate during a well completion process; determining a second rate for simulating the stage completion, the second rate being different than the first rate; simulating the stage completion at the second rate by determining a second amount of energy used for the stage completion at the second rate; and comparing the first amount of energy to a second amount of energy used in the stage completion to determine a trade-off between energy usage and pumping time.

In another aspect, determining the first amount of energy used is based on slurry channel data and treating pressure data collected from a wellbore using one or more sensors.

In another aspect, the first rate is determined based on the slurry channel data and the treating pressure data.

In another aspect, determining the second amount of energy used includes deriving updated slurry rate data and updated treating pressure data based on the second rate; and determining the second amount of energy using the updated slurry rate data and the updated treating pressure data.

In another aspect, the method includes identifying one or more data points after simulating the stage completion at the second rate, the one or more data points indicating violation of one or more performance constraints of the well completion process.

In another aspect, the one or more performance constraints include one or more of a treating pressure threshold, a slurry rate threshold, and a horsepower threshold.

In another aspect, identifying the one or more data points comprises determining a corresponding binary channel data for each performance constraint, the corresponding binary channel data being equal to one when a corresponding one of the treating pressure threshold, the slurry rate threshold, and the horsepower threshold is violated and zero otherwise.

In one aspect, a method of optimizing hydraulic fracturing includes determining a first amount of energy used for a stage completion at a first slurry rate and a first treating pressure during a well completion process; determining at least one of a second slurry rate and a second treating pressure for simulating the stage completion, the second slurry rate being different than the first slurry rate; simulating the stage completion at the second slurry rate by determining a second amount of energy used for the stage completion at the second slurry rate; and whereby a new stage is completed using at least one of a slurry rate and a treating pressure based on the second amount of energy used for the stage completion at the second rate.

In another aspect, the method includes identifying one or more data points after simulating the stage completion at the second rate, the one or more data points indicating violation of performance constraints of the well completion process, wherein the new stage is completed using the at least one of the slurry rate and the treating pressure based on the second amount of energy if the one or more data points indicate that the new stage completion using the second amount of energy does not violate the performance constraints.

In one aspect, a controller is configured to simulate attributes of a stage completion, The controller includes one or more memories having computer-readable instructions stored therein and one or more processors. The one or more processors are configured to execute the computer-readable instructions to determine a first amount of energy used for a stage completion at a first rate during a well completion process; determine a second rate for simulating the stage completion, the second rate being different than the first rate; simulate the stage completion at the second rate by determining a second amount of energy used for the stage completion at the second rate; and compare the first amount of energy to a second amount of energy used in the stage completion to determine a trade-off between energy usage and pumping time.

In one aspect, one or more non-transitory computer-readable media include computer-readable instructions, which when executed by one or more processors of a controller configured to simulate attributes of a stage completion, cause the controller to determine a first amount of energy used for a stage completion at a first rate during a well completion process; determine a second rate for simulating the stage completion, the second rate being different than the first rate; simulate the stage completion at the second rate by determining a second amount of energy used for the stage completion at the second rate; and compare the first amount of energy to a second amount of energy used in the stage completion to determine a trade-off between energy usage and pumping time.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. It should be noted that the drawings are not necessarily to scale; however, the emphasis instead is being placed on illustrating the principles of the inventive concepts. Also, in the drawings the like reference characters may refer to the same parts or similar throughout the different views. It is intended that the embodiments and figures disclosed herein are to be considered illustrative rather than limiting.

DETAILED DESCRIPTION

Figure 1:
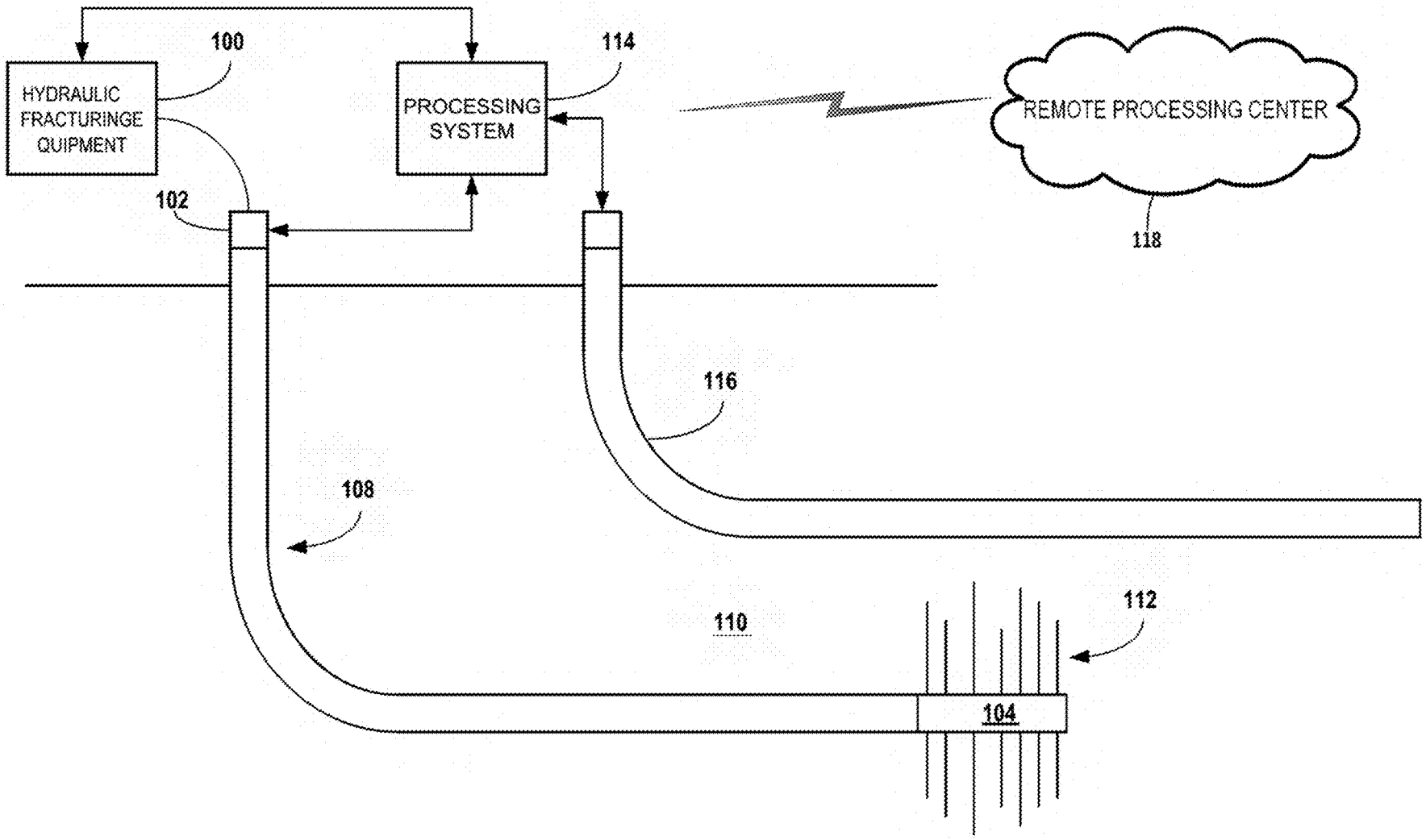
FIG. 1 illustrates an example on-site setting for performing hydraulic fracturing, according to an aspect of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Thus, the following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be references to the same embodiment or any embodiment; and, such references mean at least one of the embodiments.

Reference to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others.

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms are provided. A recital of one or more synonyms does not exclude the use of other synonyms. The use of examples anywhere in this specification including examples of any terms discussed herein is illustrative only and is not intended to further limit the scope and meaning of the disclosure or of any example term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, technical and scientific terms used herein have the meaning as commonly understood by one of ordinary skill in the art to which this disclosure pertains. In the case of conflict, the present document, including definitions will control.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

As noted above, aspects of the present disclosure involve a method and system for simulating the effect of altering the speed at which a stage is hydraulically fractured. The "speed" for hydraulic fracturing a stage is governed, at least in part, by the rate at which the fracturing fluid pumps are run. There is a tradeoff between the power/energy used by the pumps at different rates to speed up the process and there are also various limits at which hydraulic fracturing can or should occur. In one example, the simulation involves producing information about altering parameters (e.g., speed) of the hydraulic fracturing process and deriving information about energy/power consumption if the process were run at the simulated rates. In many instances, a simulation may be run against a stage of a well, and the information from the simulation may be used to alter the respective parameters of a different stage in the same well. Alternatively, or additionally, the information from a simulation run against a stage of a well may be used to alter parameters for a different well, which is particularly informative when the well is through the same formation as the well (or stage) data used for the simulation.

The process of simulating the effect of altering the rate of fracturing operations may be such that a rate for altering (e.g., speeding up) a stage completion is determined (may be referred to as a speed-up rate) after data and channel calibrations, identification of a target rate of fluid injection (e.g., in barrels per minute (BPM)) and a time to achieve the target rate. This speed-up rate may be used to simulate a faster stage completion (relative to some base rate or the rate at which the well was actually hydraulically fractured). A pressure-rate relationship is then estimated, and the simulation is carried out using the pressure-rate relationship and the speed-up rate. Based on the results, a hydraulic horsepower (energy used) for the simulated job is compared to the hydraulic horsepower for completing the job at the typical or designed rate and for the typical or designed amount of pumping time. Accordingly, effects of speeding up a stage completion on energy usage and pumping time can be determined. In one example and as a post-processing step, the simulation results are examined to determine and identify regions where potential operation constraints are violated due to the speed up. The results may then be presented on a terminal to operators and analyst for review and/or further processing, and the results may also be accessed by a system for further processing and from which completion plans and hydraulic fracturing operations may be determined and altered.

Hereinafter, each operation of the simulation process and the possible actions relative to completion and hydraulic fracturing are described.

FIG. 1 illustrates an example on-site setting for performing hydraulic fracturing, according to an aspect of the present disclosure.

The system diagram is representative of a hydraulic fracture system 100 operably coupled with a well head 102 and set up to hydraulically fracture stages 104 of a horizontal section 106 of a well 108. The hydraulic fracturing equipment may include pump trucks, sources of water (e.g., water trucks), and sources of proppant, diverter, and other substances that may be combined with water and injected into the well as part of the hydraulic fracturing process. In some configurations, a pump truck is connected to the well head 102 to pump, under controlled pressure and rate, the hydraulic fracturing fluid into the well which flows through a well casing (not shown) to the stage 104 being hydraulic fractured. The casing of the stage has been perforated such that fluid pumped into the stage can flow through the perforations to open fractures 112 in the formation 110 surrounding the well. For illustration, only one stage is shown at the toe of the well; however, a horizontal section typically has numerous stages as a horizontal section of a well may be thousands of feet, and stages are discrete sections around one hundred feet. In some systems discussed herein, data and interactions with an offset well 116 may further be assessed. The offset well 116 may be fitted with various possible sensors for measuring pressure, e.g., tubing pressure in one example, within the well or within some portion or portions of the well. The well and the equipment involved in the hydraulic fracturing process may include sensors, gauges, and other devices to monitor and record data associated with the hydraulic fracturing processes. The data may then be reported and stored at a processing system 114. The processing system 114 may involve one or more computing devices, at the well site. The processing system 114 may be in wired or wireless communication with various aspects of the well and/or the fracturing equipment.

Processing system 114 may be communicatively coupled to an off-site (remote) processing center 118. As will be described below, remote processing center 118 may receive streams of data from processing system 114 to perform real-time processing of the received data for simulating the effect of altering the speed at which a stage is hydraulically fractured and the resulting tradeoff between the power/energy used by the pumps at different rates to speed up the process. There may be one or more terminals (not shown) communicatively coupled to processing center 118 on which various results of data analysis/simulations may be viewed, commands for controlling the fracturing process and/or modify data analysis processes may be provided, etc. Examples of such terminals include, but are not limited to, a handheld device such as a laptop, a smartphone, a tablet, a desktop computer or workstation, etc.

While not shown in FIG. 1, a zipper fracturing process may involve multiple wells such as well 108, each with multiple fracture stages such as stages 104. Various sensors installed in each such well may monitor statistics and data, as described above for each stage of fracturing of each well. Such data is then transmitted, using any known or to be developed method, from on-site processing systems such as processing system 114 to remote processing center 118 for analysis, as will be described below. Remote processing center 118 may also be referred to as remote processor 118 and/or controller 118.

Hereinafter, example embodiments directed to simulating the effect of altering the speed at which a stage is hydraulically fractured is described.

In one example, the simulation process uses existing treating data for a well, which may have been collected by various sensors installed throughout a well as described above with reference to FIG. 1. More specifically, the example process uses a slurry rate (which may be referred to as a slurry rate channel and is typically recorded in barrels per minute (bpm)) and an associated treating pressure (which may be referred to as a treating pressure channel and is typically recorded in pounds per square inch (psi)). The slurry rate refers to the rate at which hydraulic fracturing fluid is pumped into a stage. The hydraulic fracturing fluid—or "slurry"—is typically a combination of water and proppant (e.g., sand), and may also include a small proportion of chemicals. Generally speaking, the slurry is pumped in the well under high pressure and flows through perforations in the well casing to fracture the formation and the proppant holds those fractures open. Treating pressure refers to the pressure, typically but not always measured and recorded in pounds per square inch (psi), in the well or in the stage as detected by various sensors. The treating pressure refers to the pressure measured while a stage is being hydraulically fractured. The treating pressure is a function of the slurry rate but is also function of other parameters such as chemical concentrations of friction reducer, pipe characteristics such as diameter, fluid characteristics of the slurry such as viscosity and density, as well as attributes of the formation being fractured. The slurry rate and treating pressure channels may be chronologically aligned—e.g., correlated in time.

Figure 2:
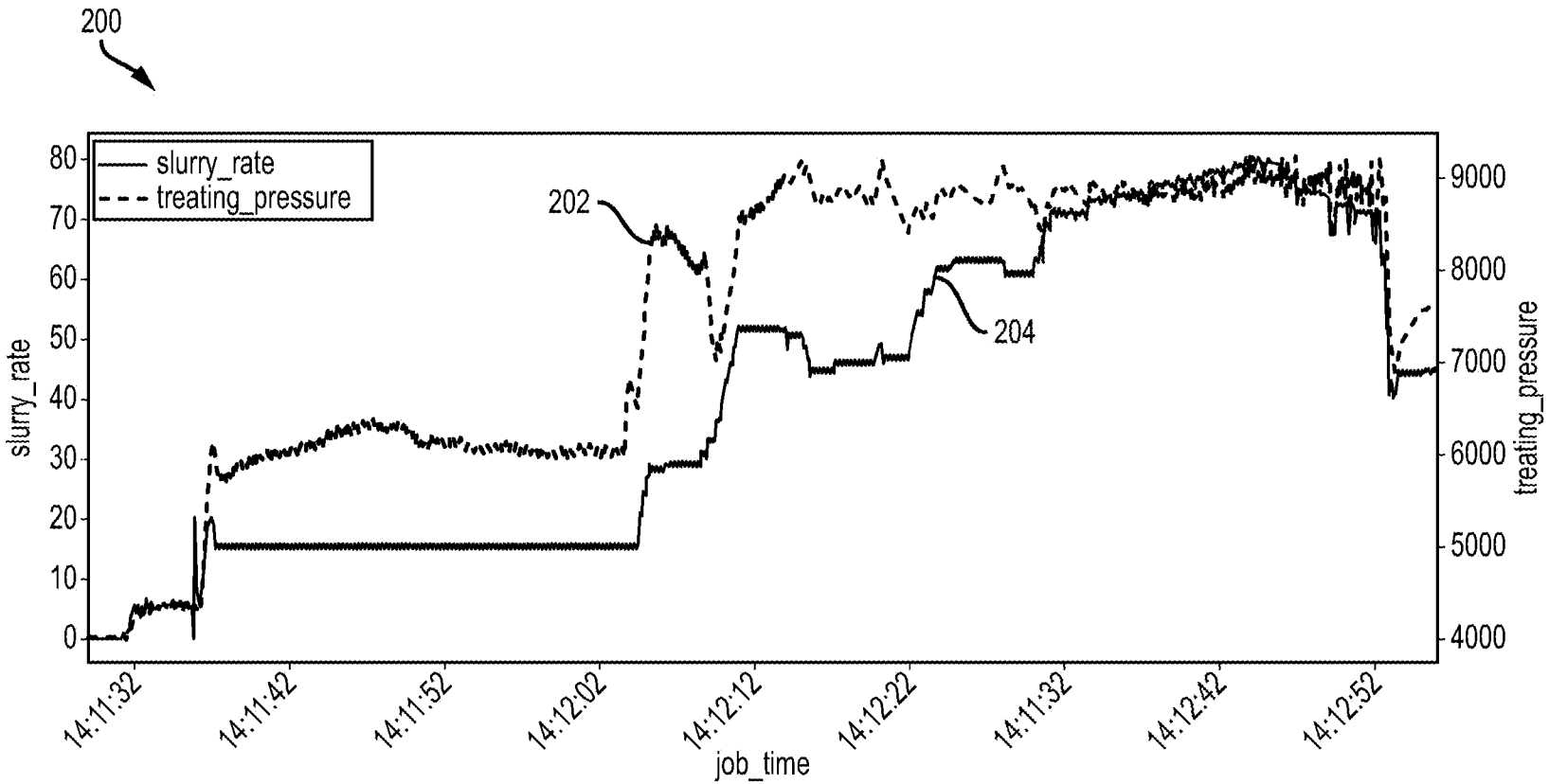
FIG. 2 illustrates one example of a slurry rate channel and a treating pressure channel correlated by job time, according to an aspect of the present disclosure.

FIG. 2 illustrates one example of a slurry rate channel and a treating pressure channel correlated by job time, according to an aspect of the present disclosure. For a simulation, it is preferable that slurry rate and treating pressure are analyzed for a stage in a well relative to assessing and modifying fracturing operations of another stage in the same well (e.g., well 108 or well 116), or a stage in a well (e.g., well 108) of the same formation albeit of a separate well (e.g., well 116). Example graph 200 of FIG. 2 illustrates correlation between a slurry rate channel 202 and a treating pressure channel 204 by job time.

Figure 3:
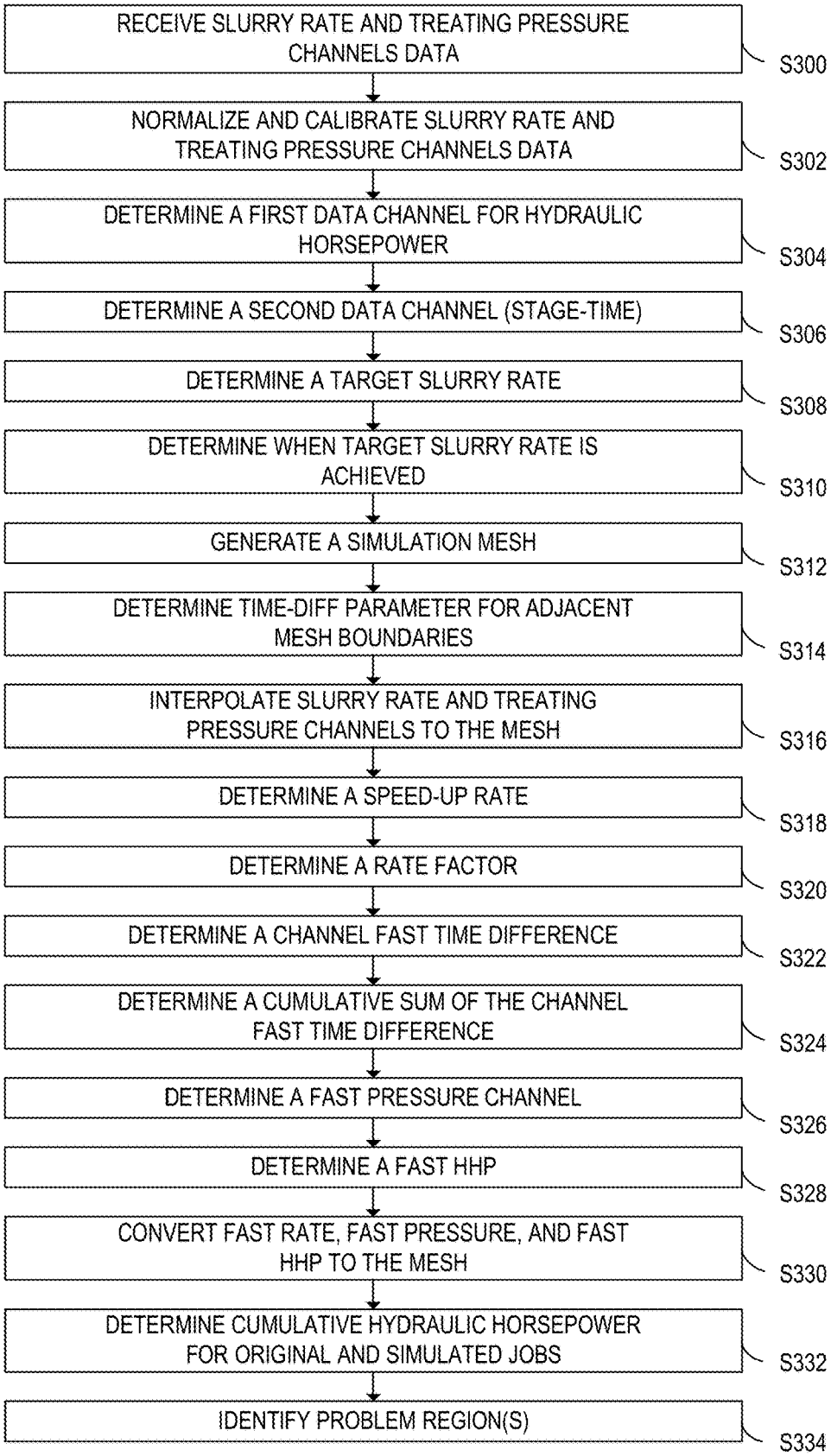
FIG. 3 illustrates an example process of simulating the effect of altering the speed at which a stage is hydraulically fractured, according to an aspect of the present disclosure.

FIG. 3 illustrates an example process of simulating the effect of altering the speed at which a stage is hydraulically fractured, according to an aspect of the present disclosure. The process of FIG. 3 will be described from the perspective of controller 118. It should be noted that controller 118 may have one or more memories having computer-readable instructions stored therein, which when executed by one or more processors associated with controller 118, cause controller 118 to perform the steps described below. In describing FIG. 3, references may be made to FIGS. 1 and 2.

At S300, controller 118 may receive slurry rate and treating pressure channels data as shown in FIG. 2. The slurry rate and treating pressure channels data may be received at controller 118 from sensors installed within the relevant wells (e.g., well 108 and well 116) or alternatively from processing system 114.

At S302, controller 118 may normalize and calibrate the slurry rate and treating pressure channels data received at S300, and any other channels that may be integrated in the process. In one example, the slurry rate and treating pressure channels are processed to eliminate negative rates by clipping any negative rates to zero. Additionally, if the slurry rate is not recorded in bpm, it is converted to bpm. Similarly, if the treating pressure is not recorded in psi, then it may be converted to psi. Other measurement units may also be used and if deemed necessary, the original channels may be converted into the measurement unit of the process. As later steps are based on bpm and psi values, the process involves conversion to the same. The process could, however, be based on other units of measurement for slurry rate and treating pressure.

At S304, controller 118 may determine a first data channel for hydraulic horsepower (HHP). In one example, there may not be a channel of measurements of HHP but instead the overall process may involve generating an HHP data channel. In one example, an HHP channel is generated using Formula 1, referenced below. As can be seen, the HHP channel may be based on slurry rate and treating pressure. In one example, the HHP is a derivation of the actual hydraulic horsepower used in processing the stage associated with the slurry rate and treating pressure channels. Formula (1) and the derived HHP channel, as will be explained below, are used for comparison with a fast HHP of the simulated job to identify differences in energy/power use.

$$\text{HHP}=\text{slurry rate}*\text{treating pressure}/40.8. \qquad \text{(Formula 1)}$$

The conversion factor of 40.8 may be adjusted depending on the pumping system and other aspects of the environment. In other words, this conversion factor is not limited to 40.8 and may be a configurable parameter determined based on experiments and/or empirical studies.

Figure 4:
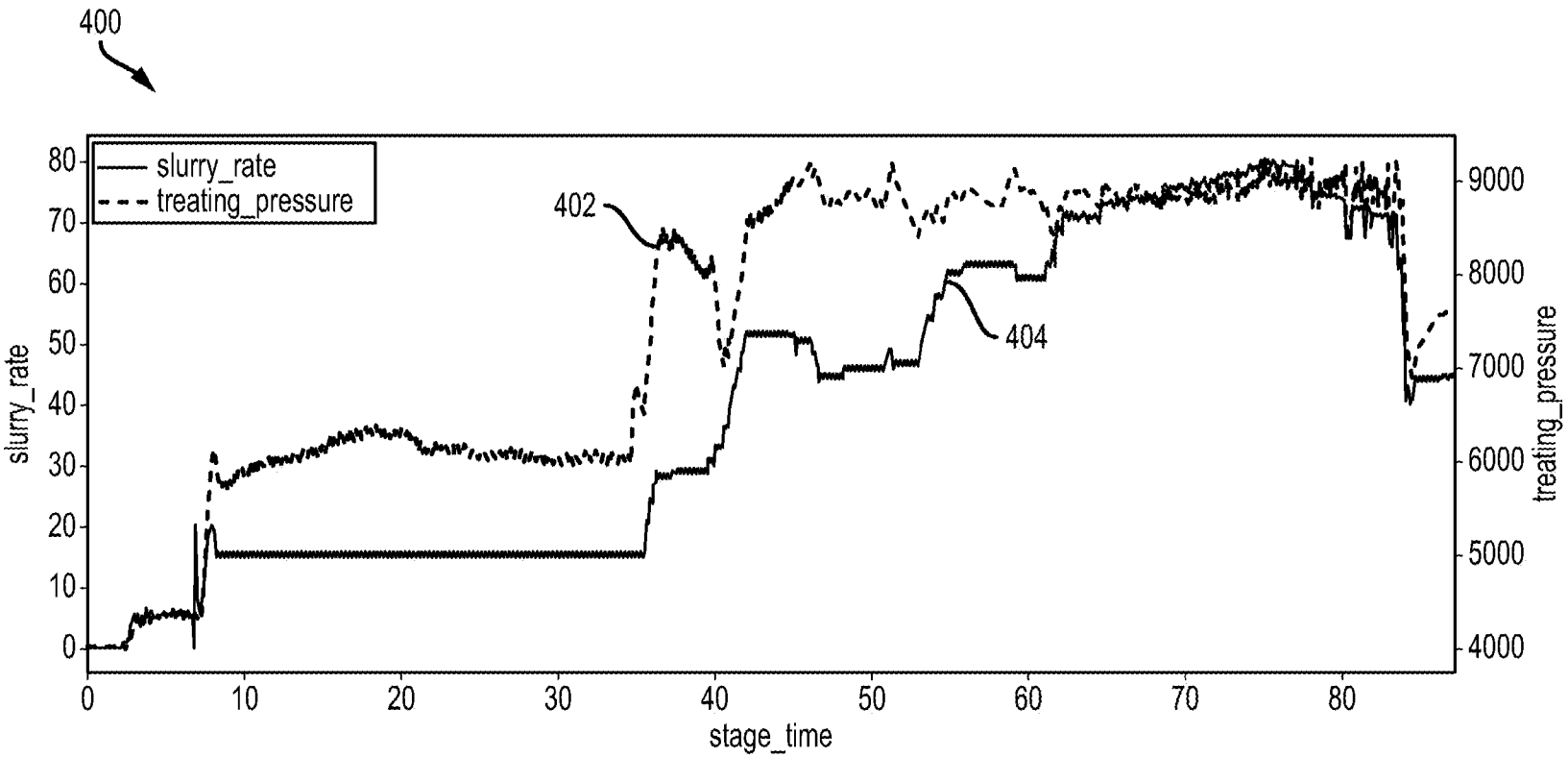
FIG. 4 is a graphical depiction of the slurry rate and treating pressure channels against the stage-time, according to an aspect of the present disclosure.

At S306, controller 118 may further determine a second data channel referred to as "stage-time." The stage-time channel may relate to the time from a start of a given stage—e.g., when fracturing fluid is initially pumped to begin fracturing a stage or may relate to another significant time reference (e.g., when a target rate is achieved). The stage-time may account for the time from some starting point as opposed to a time stamp of the actual time of some event. In one example, stage-time is recorded in seconds based on the initiation of pumping. Hence, it is a measure from the start of pumping. FIG. 4 is a graphical depiction of the slurry rate and treating pressure channels against the stage-time, according to an aspect of the present disclosure. As shown in FIG. 4, graph 400 depicts slurry rate 402 and treating pressure 404 channels against stage-time (horizontal access)—beginning at time 0 when pumping of the slurry is initiated.

Next, at S308, controller 118 may determine a target slurry rate. In one example, controller 118 analyzes the data channels determined at S304 and S306 to obtain a target slurry rate (referred to as "target-rate"). The target-rate may be defined as a desired or designed slurry rate at which hydraulic fracturing fluid is injected into a given stage. The target rate may be obtained in any number of possible ways such as a user input (e.g., via a terminal connected to controller 118), by referencing a stored target rate, by estimating the rate based on historical data (e.g., from previous fracturing operations of the same formation), and through various other possible ways. Additionally, target rate can be automatically determined such as through the methods described in U.S. patent application Ser. No. 16/951,946 titled "METHODS AND SYSTEMS FOR PROCESSING TIME-SERIES WELL DATA USING HIGHER ORDER CHANNELS TO IDENTIFY FEATURES THEREIN AND ALTER HYDRAULIC FRACTURING OPERATIONS BASED THEREON, filed on Nov. 20, 2020 and which is hereby incorporated by reference.

Figure 5:
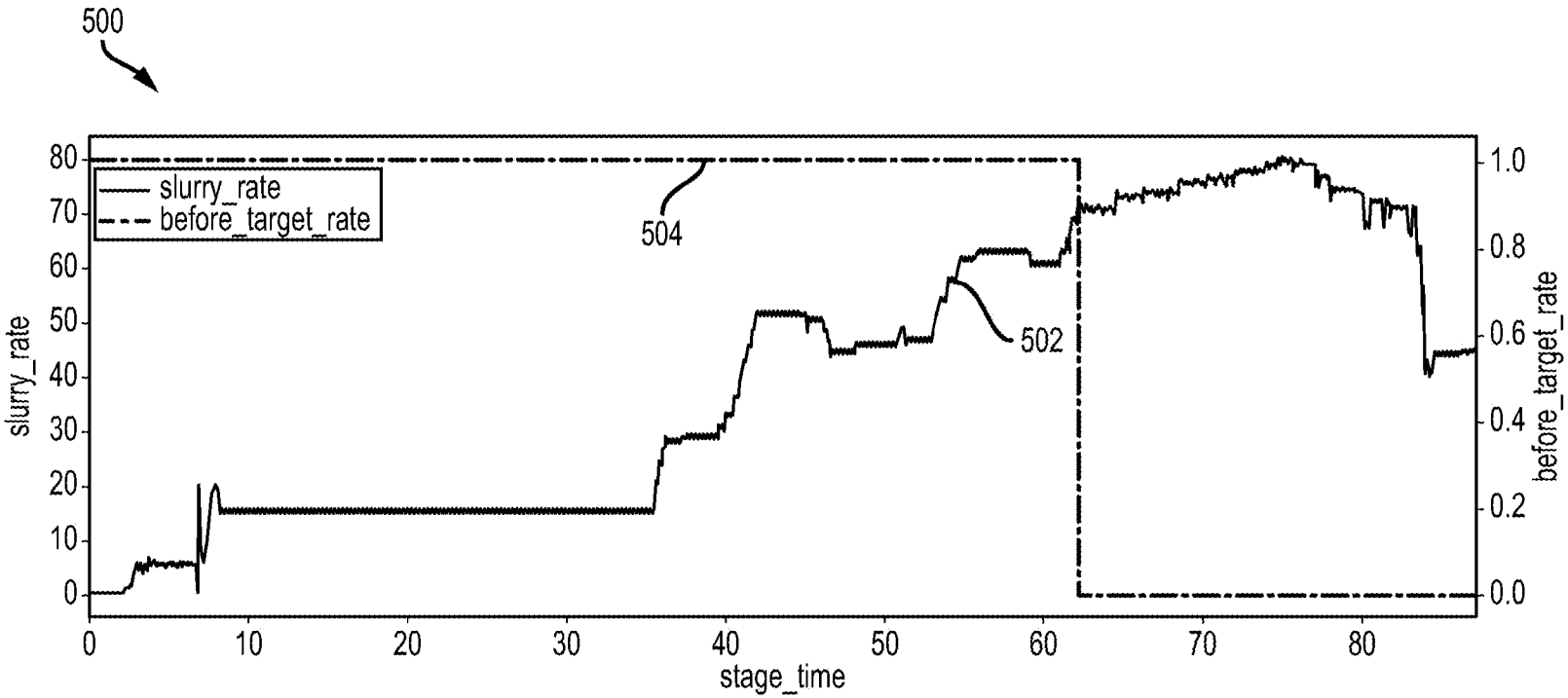
FIG. 5 illustrates an example visual output of the analysis for determining when a target slurry rate is achieved, according to an aspect of the present disclosure.

At S310, controller 118 analyzes the data channels normalized at S302, derived at S306, S308 to determine or otherwise mark when the target slurry rate is achieved. In one example, the analysis includes generating a derived binary channel with values of 1 for stage times preceding the target rate and 0 for stage times following the target rate and otherwise, as shown in FIG. 5 below. FIG. 5 illustrates an example visual output of the analysis for determining when a target slurry rate is achieved, according to an aspect of the present disclosure. Graph 500 shows slurry rate 502, which may be the same as slurry rate depicted in FIGS. 2 and 4, and a target slurry rate 504 determined at S310 versus stage time determined at S306.

Figure 6:
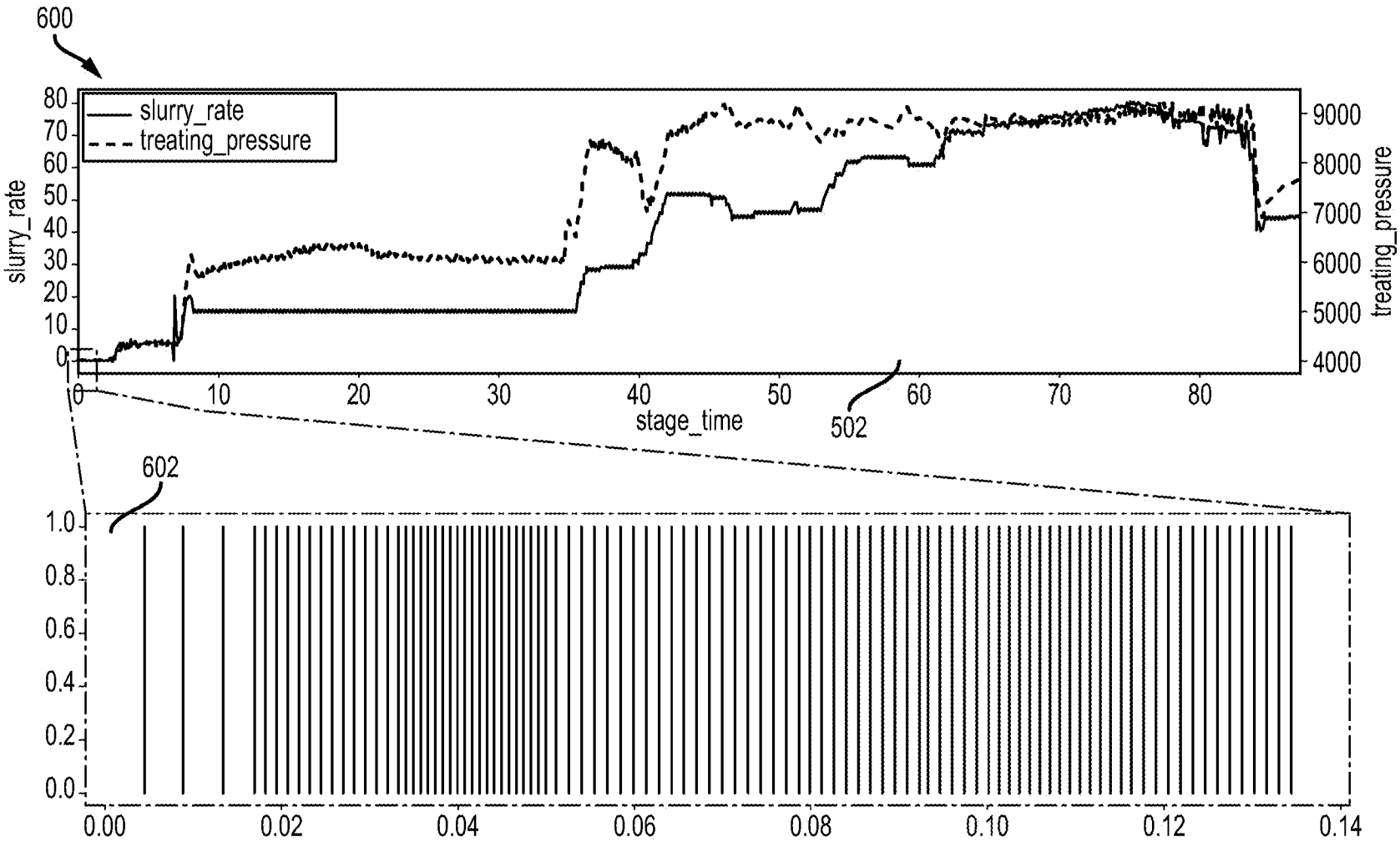
FIG. 6 illustrates an example of a dynamic mesh for a small interval, according to an aspect of the present disclosure.

At S312, controller 118 may generate a simulation mesh where the stage-time scale is refined into a finer resolution for simulation. In one example, a uniform time mesh may be created by subdividing each step of the stage-time (e.g., 0, 10, 20, 30 . . . 80, as shown in FIG. 3) into a fixed number of buckets. Alternatively, a dynamic time mesh can be created where more buckets are created as the slurry rate increases. FIG. 6 illustrates an example of a dynamic mesh for a small interval, according to an aspect of the present disclosure. Graph 600 of FIG. 6 shows the example dynamic mesh 602 that can provide a way to simulate faster or slower slurry rates. Scaling the mesh is equivalent to scaling the slurry rate but doing so makes book-keeping various quantities more efficient while respecting an assumption of the simulation: that events in the job are better described by the cumulative volume in the stage instead of based on time. This allows controller 118 to maintain the "shape" of the treatment plot when pumped at different rates. The mesh gives controller 118 an efficient way to move between the "time" and "volume" perspectives.

At S314, controller 118 may determine a derived time-diff parameter that measures a width (in minutes) between two adjacent mesh boundaries. Each grid interval corresponds to a particular volume of fluid that was pumped (e.g., can be considered a small cylinder of fluid). Scaling the interval "controls" how fast that specific volume ("cylinder") of the job is pumped. In one example and for simulation, if a shorter interval is used, then that specific volume ("cylinder") is considered being pumped faster and vice versa. As will be described below, fast-diff may also be determined for adjacent boundaries that is essentially a scaled version of time-diff. The scaling factor is essentially constant except when operating constraints are violated (i.e., when the hydraulic fracturing system does not speed up past the target rate (that is why the fast-rate formula has the min in it and why it isn't just one "scaling factor")).

At S316, controller 118 may interpolate the slurry rate and treating pressure channels to the mesh. In one example, the slurry rate and treating pressure channels received at S300 may be interpolated to the mesh or alternatively a normalized and calibrated slurry rate and treating pressure channels (per S302) may be interpolated to the mesh. Any number of known or to be developed interpolation schemes may be used for interpolating the slurry rate and treating pressure channels to the mesh including, but not limited to, linear interpolation, nearest interpolation, etc.

At S318, controller 118 may determine a speed-up rate (or "Fast-rate") using formula (2). The speed-up rate may be defined as a relatively faster rate for completing a stage that the slurry rate obtained at S300 and calibrated at S302, based on which faster stage simulation is performed to determine a trade-off between energy used and pumping time, as described above. In one example, it is also possible to slow down the rate but because speed-up is the more typical use, the term speed-up is used.

$$\text{Fast-rate}=\min(\text{slurry rate}*s,\text{target rate}) \qquad \text{Formula (2)}$$

In Formula (2), 's' is a constant multiplication factor determined based on experiments and/or empirical studies. By adjusting 's' in Formula (2), faster or slower rates are derived. For example, if s=1.1 is used then the job is pumped 10% faster up to a maximum of the target rate. In another example, if s=1.5 then the job is pumped 50% faster up to a maximum of the target rate. The minimum function in Formula (2) is used to ensure that fast-rate (the simulated rate) does not exceed the target rate.

At S320, controller 118 may determine a rate-factor that is indicative of an actual speed-up rate for simulating a faster stage completion. This accelerated parameter can be less than 's' given the minimum value taken in Formula (2). The rate-factor can be determined by Formula (3) shown below and using the fast-rate determined using formula (2):

$$\text{Rate-factor}=\text{fast-rate}/\text{slurry rate} \qquad \text{Formula (3)}$$

Figure 7:
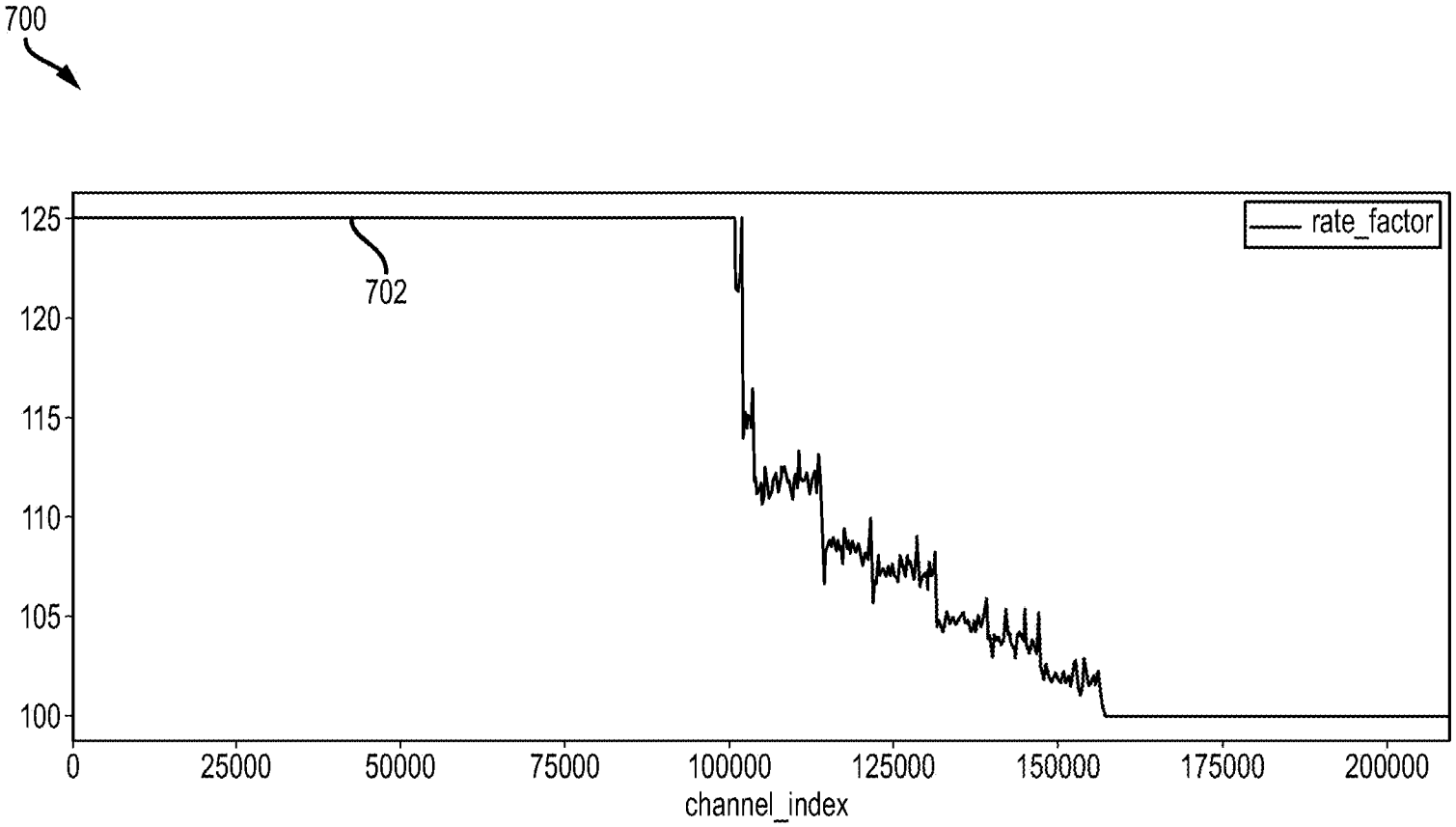
FIG. 7 is an example visual representation of the derived rate-factor, according to an aspect of the present disclosure.

FIG. 7 is an example visual representation of the derived rate-factor, according to an aspect of the present disclosure. Graph 700 of FIG. 7 illustrates an example where a 25% faster pump is simulated. This is shown in that rate factor 702 at an early part of the job is constant at 1.25. At around channel_index 100,000 the rate-factor starts to decrease; this is because increasing the pump rate by 25% would exceed the target rate, which the hydraulic fracturing system does not allow. At this point the rate-factor is just the "speed up" (less than 25%) that will cause the pumps to hit target slurry rate. At about channel_index 155,000, graph 700 shows that rate factor 702 remains at about 1, which indicates that the hydraulic fracturing system has reached the target slurry rate and that running the pumps faster than they were originally pumped is no longer being simulated.

At S322, controller 118 may determine a channel fast-time-difference based on Formula (4) below and using the time-diff parameter derived from measuring the width of the mesh grid of FIG. 6 as described above with reference to S314 and the rate-factor from Formula (3):

$$\text{Fast-time-difference}=\text{time-diff}/\text{rate-factor} \qquad \text{Formula (4)}$$

While 's' is used as a simple factor to determine the fast-rate, the inventive concepts are not limited to such a constant and more elaborate rate acceleration functions may be utilized and relied upon instead.

At S324, controller 118 may determine a cumulative sum (an integral) of the fast-time-difference using Formula (5) below:

$$\text{fast_time}[k] = \sum_{i=0}^{k} \text{fast_time_diff}[i] \qquad \text{Formula (5)}$$

with i and k being positive integers in the fast-time and fast-time-difference channels and determined based on experiments and/or empirical studies.

Figure 8:
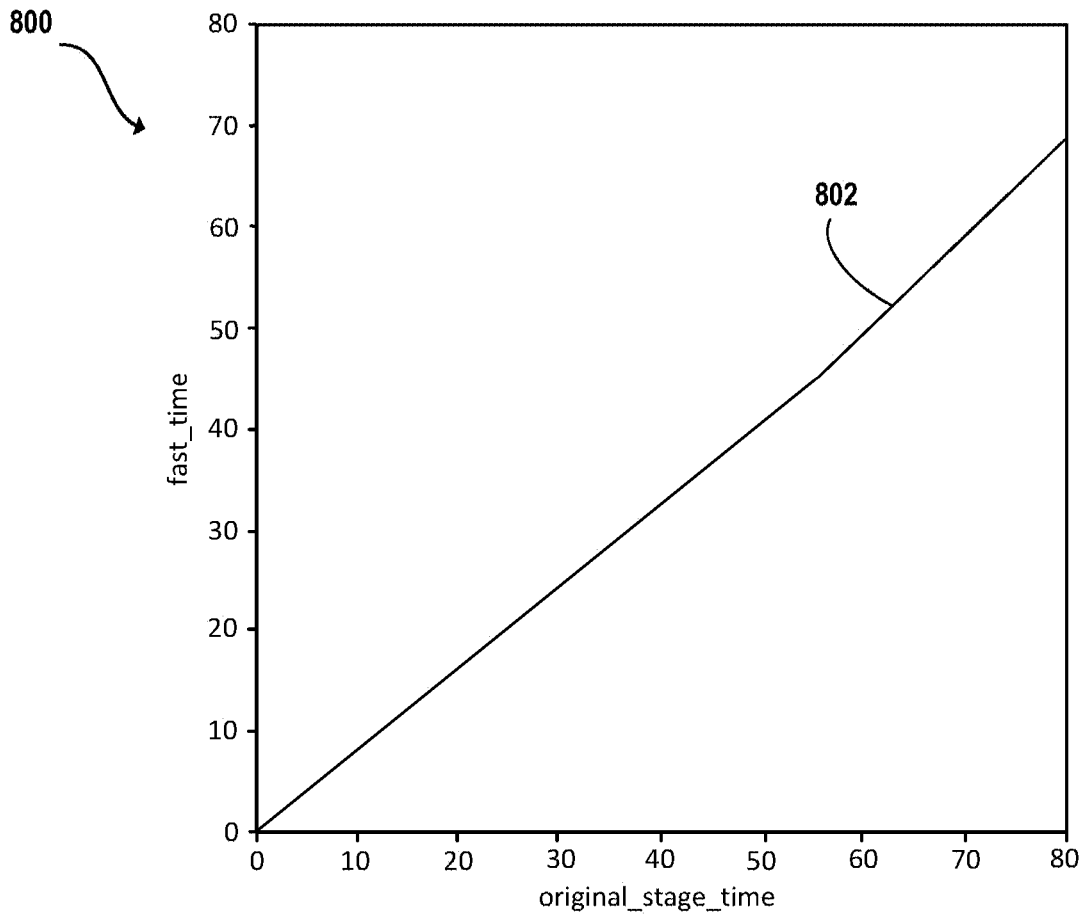
FIG. 8 illustrates a relationship of the fast-stage-time (fast-time) with the stage-time (original-stage-time), according to an aspect of the present disclosure.

In one example, if the consecutive interval widths are 1, 1.5, 1, and 2 seconds then the mesh boundaries occur at stage-times: 0 s, 1 s, 2.5 s, 3.5 s, 5.5 s. The cumulative sum can indicate an association between an update stage-time (fast-stage-time) and the fast-rate. FIG. 8 illustrates a relationship of the fast-stage-time (fast-time) with the stage-time (original-stage-time), according to an aspect of the present disclosure. This relationship is depicted using line 802 in graph 800.

With a fast-rate channel calculated, at S326, controller 118 may determine a fast-pressure channel using Formula (3) and Formula (6):

$$\text{Fast-pressure}=\text{treating pressure}*\text{rate-factor} \qquad \text{Formula (6)}$$

For context and to understand the fast-pressure, in one example, a 25% increase in rate will result in a 25% increase in pressure, indicating a one to one relationship. That is a fairly simple assumption in the simulation. Alternatively, more sophisticated relationships may be used. In one example, fast-pressure can be more precisely determined when a rate-pressure relationship is provided or estimated.

At S328 and using Formulate (6), controller 118 may determine a fast-hhp per Formula (7):

$$\text{Fast-hhp}=\text{fast-rate}*\text{fast-pressure}/40.8 \qquad \text{Formula (7)}$$

Figure 9:
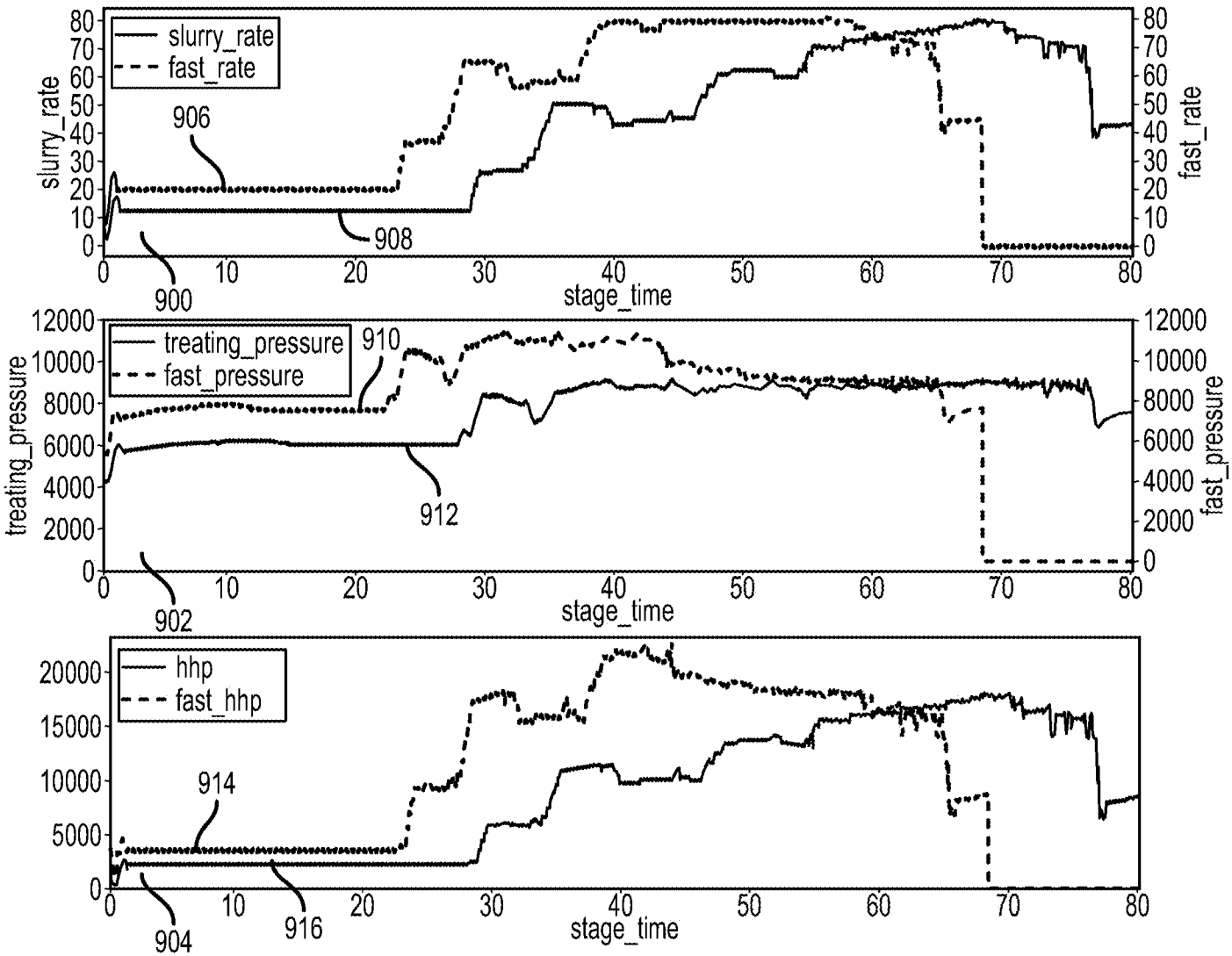
FIG. 9 illustrates an example mapping of fast rate, fast pressure, and fast hhp to the mesh, according to an aspect of the present disclosure.

At S330, controller 118 may convert the fast-rate, fast-pressure, and fast-hhp (fast channels), as determined per Formula (3), Formula (6), and Formula (7), to the original stage-time mesh as described above (e.g., per-second data or 1/60th of a minute). FIG. 9 illustrates an example mapping of fast rate, fast pressure, and fast hhp to the mesh, according to an aspect of the present disclosure. FIG. 9 illustrates three graphs 900, 902, and 904. Graph 900 shows fast rate 906 simultaneously with slurry rate 908 described above. Graph 902 shows fast pressure 910 simultaneously with treating pressure 912 described above. Graph 904 shows fast hhp 914 simultaneously with hhp 916 described above.

At S332, controller 118 may determine a cumulative hydraulic horsepower (hhp-hours) for the original job and a cumulative hydraulic horsepower for the simulated job. In one example, controller 118 may determine a cumulative hydraulic horsepower using Formula (8) below, where hhp as determined per Formula (1) is used for hhp (T).

$$Hhp\text{-}hours(t) = \int_0^t hhp(\tau)d\tau \qquad \text{Formula (8)}$$

where t ranges from 0 to the time of completion of the underlying job.

Formula (9) is a discrete version of Formula (8) with time ticks being spaced out (e.g., one minute apart).

$$Hhp\text{-}hours[t] = \frac{1}{60}\sum_{i=0}^{t} hhp[i] \qquad \text{Formula (9)}$$

Similarly, controller 118 may determine a cumulative hydraulic horsepower (hhp-hours) for the simulated job is determined using Formula (10) below, where fast-hhp as determined per Formula (7) is used for hhp (T).

$$Fast\text{-}hhp\text{-}hours(t) = \int_0^t hhp(\tau)d\tau \qquad \text{Formula (10)}$$

where t ranges from 0 to the time of completion of the underlying job.

Formula (11) is a discrete version of formula (10) with time ticks being spaced out (e.g., one minute apart).

$$Fast\text{-}hhp\text{-}hours[t] = \frac{1}{60}\sum_{i=0}^{t} hhp[i] \qquad \text{Formula (11)}$$

Figure 10:
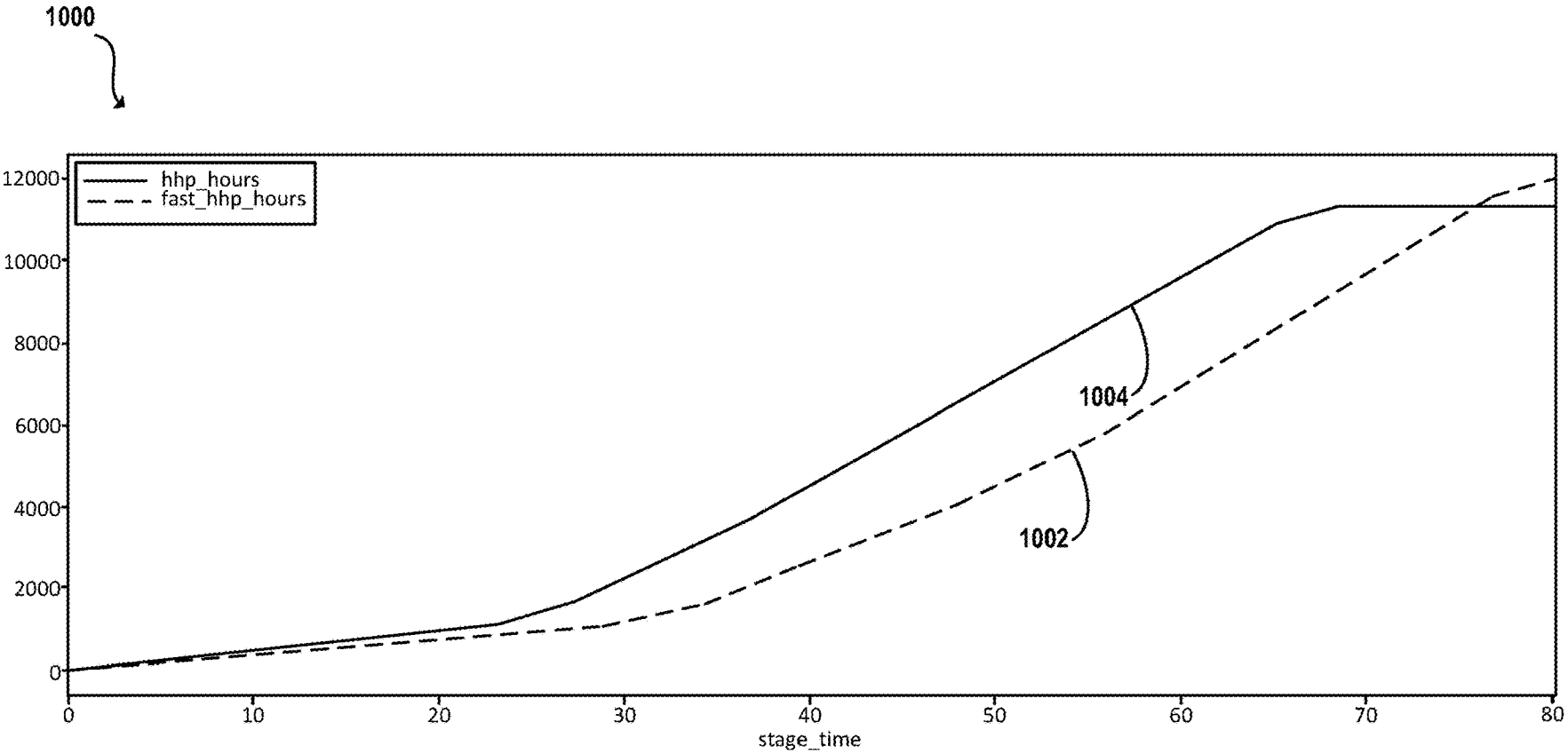
FIG. 10 illustrates a comparison between energy used in a normal stage completion and energy used in a simulated faster stage completion, according to an aspect of the present disclosure.

FIG. 10 illustrates a comparison between energy used in a normal stage completion and energy used in a simulated faster stage completion, according to an aspect of the present disclosure. Graph 1000 shows hhp-hours 1002, which is determined based on Formula (8)/Formula (9) as described above with reference to S332, and the energy 1004 used in a simulated faster stage completion determined based on Formula (10)/Formula (11) as described above with reference to S332.

At S334, controller 118 may identify one or more channel problem regions. In other words, once the result of the simulation is obtained, time periods with potential operational concerns are identified. Such concerns include identified time periods where performance constraints for a stage completion are violated. This identification process may be performed as follows.

A derived channel above-pressure-limit is determined, which is equal to 1 when the simulated treating pressure is above some operational threshold Pmax (which may be determined based on experiments and/or empirical studies) and zero otherwise.

Similarly, a derived channel above-rate-limit is determined, which is equal to 1 when the slurry rate is above some operational threshold Rmax (which may be determined based on experiments and/or empirical studies) and zero otherwise.

Next, a derived channel above-hhp-limit is determined, which is equal to 1 when the hhp is above some operational threshold HPmax (which may be determined based on experiments and/or empirical studies) and zero otherwise.

Figure 11:
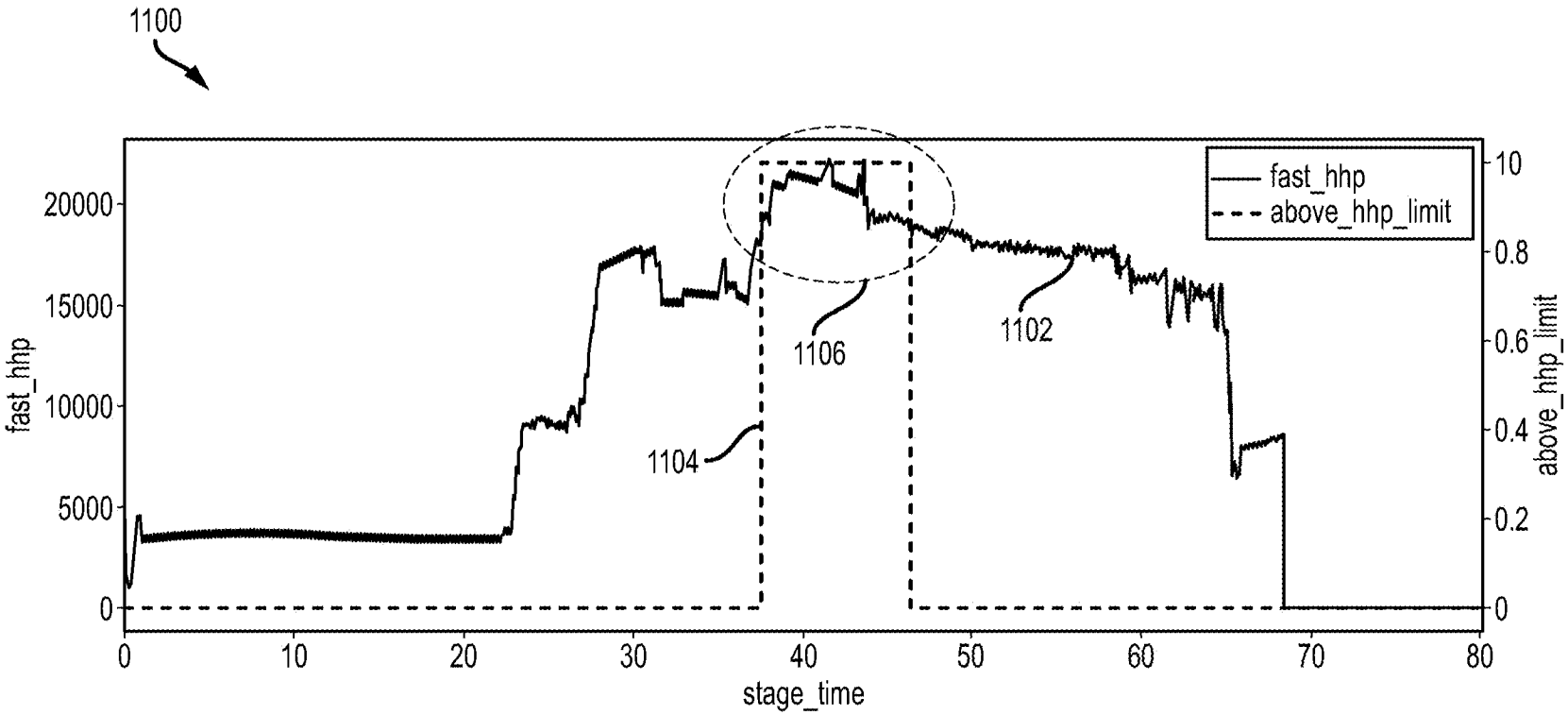
FIG. 11 is a visual representation of the derived problem-region which indicates time periods when performance constraints are violated, according to an aspect of the present disclosure.

Based on the above-pressure-limit, above-rate-limit and above-hhp-limit, a derived channel problem-region is determined, which is equal to one if and any of the above-pressure-limit, above-rate-limit and above-hhp-limit channels is equal to 1 and zero when a pretarget-rate is equal to 1. The pretarget-rate channel is a 0/1-valued channel that is 1 before target-rate is achieved and 0 after target-rate is achieved. So the problem-region only considers problems when the pre-target channel is 1, that is, before the target-rate is achieved (since the system is only simulating ("modifying") operations before the target-rate. This is done such that the simulated rate doesn't cause issues that violate operational limits. An interval in the simulated region may be identified as a "problem-region" if the simulated rate causes any of the following 1) operational rate is exceeded, 2) operational pressure limit is exceeded, or 3) operational horsepower limits are exceeded. FIG. 11 is a visual representation of the derived problem-region which indicates time periods when performance constraints are violated, according to an aspect of the present disclosure. Graph 1100 illustrates fast hhp 1102 and a binary graph 1104 that identifies problem region 1106 when fast hhp 1102 is above a corresponding HP max limit, as described above.

Figure 12:
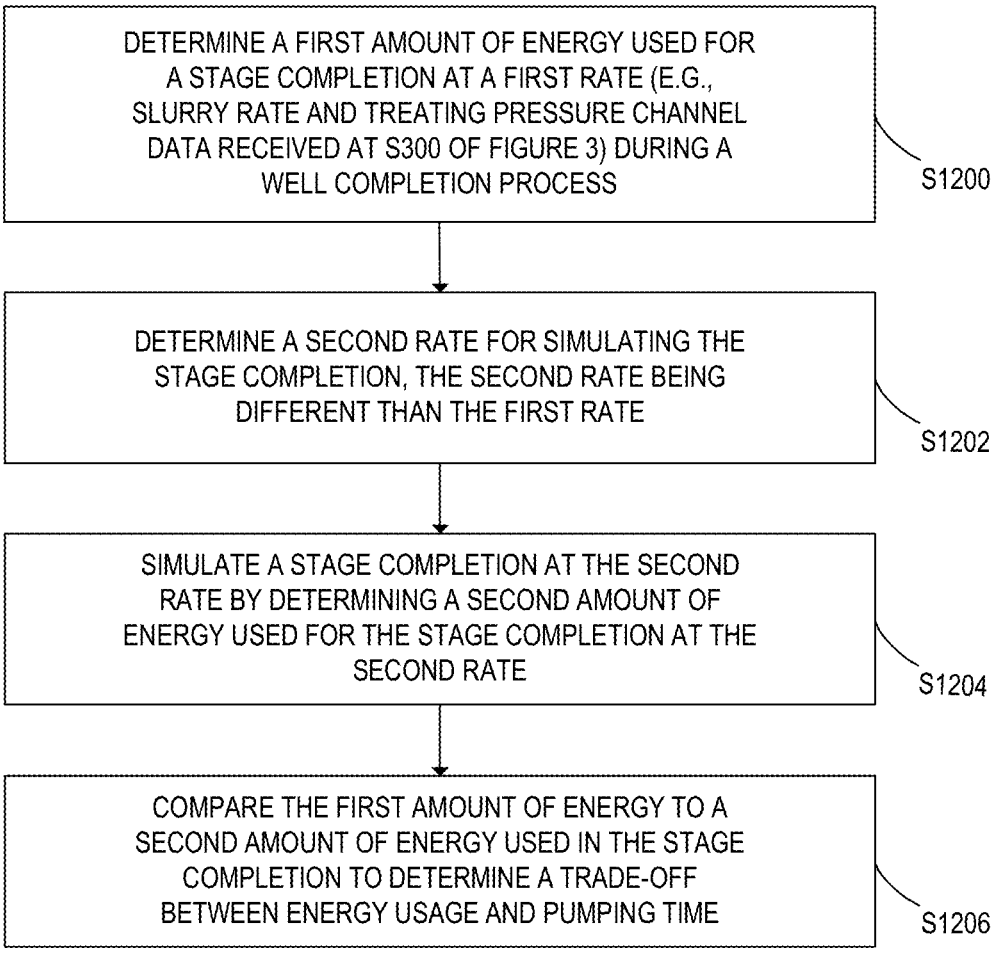
FIG. 12 is a flow chart of a process for determining trade-off between energy usage and pumping time based on the process described with reference to FIG. 3, according to an aspect of the present disclosure.

FIG. 12 is a flow chart of a process for determining trade-off between energy usage and pumping time based on the process described with reference to FIG. 3, according to an aspect of the present disclosure. Similar to the process of FIG. 3, steps of FIG. 12 will be described from the perspective of controller 118 of FIG. 1. It should be noted that controller 118 may have one or more memories having computer-readable instructions stored therein, which when executed by one or more processors associated with controller 118, cause controller 118 to perform the steps described below. In describing FIG. 3, references may be made to FIGS. 1-11.

At S1200, controller 118 determines a first amount of energy used for a stage completion at a first rate (e.g., slurry rate and treating pressure channel data received at S300 of FIG. 3) during a well completion process. The first amount of energy may be the same as the first data channel for hydraulic horsepower as determined per S304, and the cumulative hydraulic horsepower (hhp-hours) for the original job as described with reference to S332 of FIG. 3. As described with reference to FIG. 3, determining the first amount of energy used is based on slurry channel data and treating pressure data collected from the wellbore using one or more sensors and received at S300.

At S1202, controller 118 determines a second rate for simulating the stage completion, the second rate being different than the first rate. In one example, the second rate may be the same as the fast rate determined at S318 of FIG. 3. In one example, the fast rate may be determined based on the slurry rate received at S300 and normalized at S302 and the target slurry rate determined at S308.

At S1204, controller 118 simulates a stage completion at the second rate by determining a second amount of energy used for the stage completion at the second rate. In one example, determining the second amount of energy may include deriving updated slurry rate data and updated treating pressure data based on the second rate and determining the second amount of energy using the updated slurry rate data and the updated treating pressure data. The process of determining the second amount of energy used may be the same as described above with reference to S328 of FIG. 3 for determining the fast hhp and the cumulative hydraulic horsepower for the simulated job as described with reference to S332 of FIG. 3.

At S1206, controller 118 compares the first amount of energy to a second amount of energy used in the stage completion to determine a trade-off between energy usage and pumping time. A non-limiting example of this comparison is shown in FIG. 10 and described above. In one example, this comparison process may include identifying one or more data points after simulating the stage completion at the second rate, the one or more data points indicating violation of one or more performance constraints (problem region(s)) of the well completion process, as described with reference to S334 of FIG. 3. A non-limiting example of identify problem regions is shown in FIG. 11. In one example, the performance constraints include one or more of a treating pressure threshold, a slurry rate threshold, and a horsepower threshold. Furthermore, identifying the one or more data points includes deriving (determining) a corresponding binary channel data for each performance constraint, which is equal to one when a corresponding one of the treating pressure threshold, the slurry rate threshold, and the horsepower threshold is violated and zero otherwise, as described above with reference to S334 of FIG. 3.

With example systems and methods for simulating the effect of altering the rate of fracturing operations described with reference to FIGS. 1-12, the disclosure now turns to example system components and architectures that can be used to implement various system components described above such as controller 118.

Figure 13A:
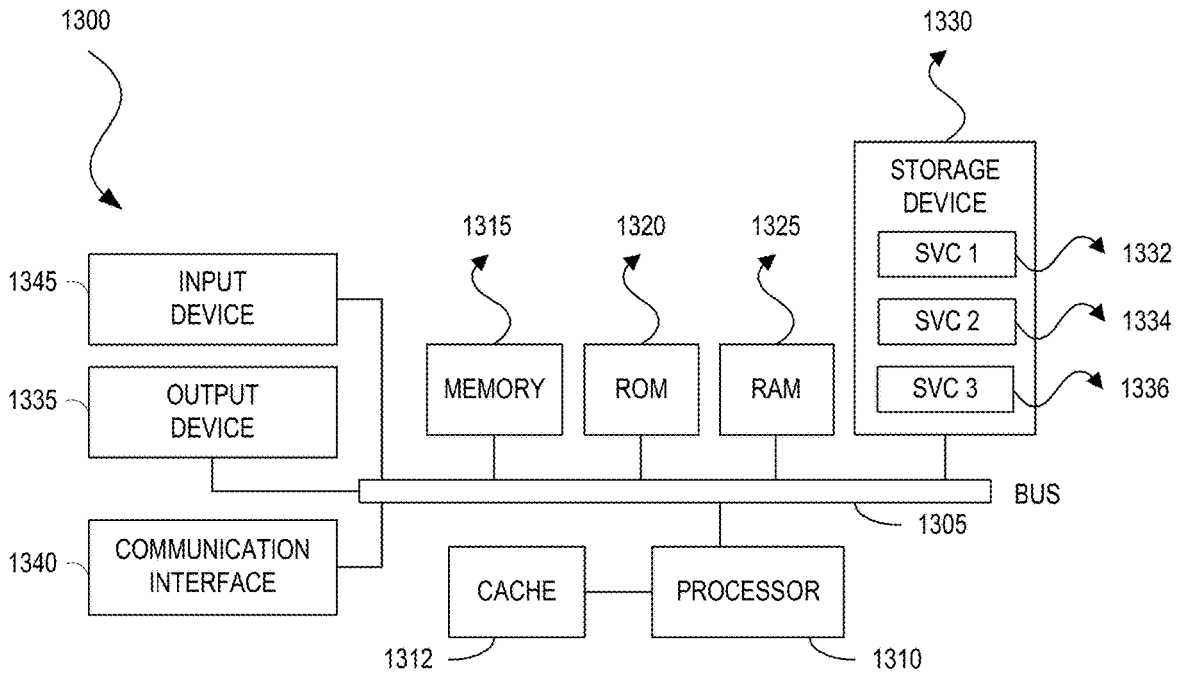
FIGS. 13A and 13B illustrate systems, according to an aspect of the present disclosure.
Figure 13B:
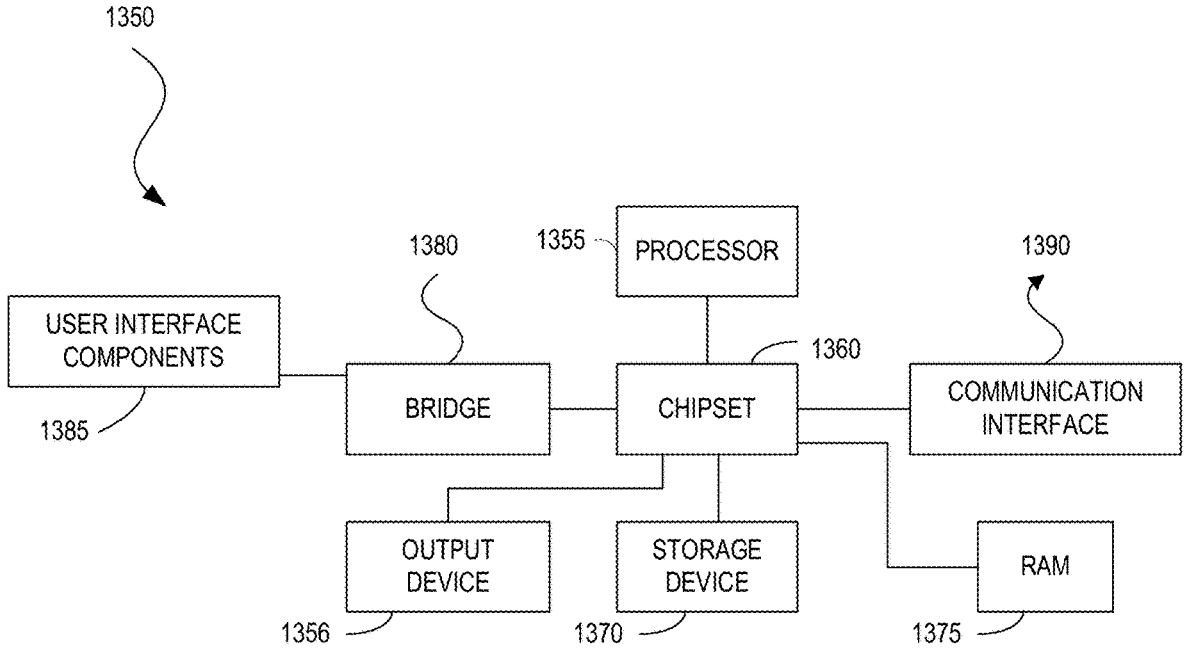

FIGS. 13A and 13B illustrate systems, according to an aspect of the present disclosure. The more appropriate system will be apparent to those of ordinary skill in the art when practicing the various embodiments. Persons of ordinary skill in the art will also readily appreciate that other systems are possible.

FIG. 13A illustrates an example of a computing system 1300 wherein the components of the system are in electrical communication with each other using a bus 1305. The computing system 1300 can include a processing unit (CPU or processor) 1310 and a system bus 1305 that may couple various system components including the system memory 1315, such as read only memory (ROM) 1320 and random access memory (RAM) 1325, to the processor 1310. The computing system 1300 can include a cache 1312 of high-speed memory connected directly with, in close proximity to, or integrated as part of the processor 1310. The computing system 1300 can copy data from the memory 1315, ROM 1320, RAM 1325, and/or storage device 1330 to the cache 1312 for quick access by the processor 1310. In this way, the cache 1312 can provide a performance boost that avoids processor delays while waiting for data. These and other modules can control the processor 1310 to perform various actions. Other system memory 1315 may be available for use as well. The memory 1315 can include multiple different types of memory with different performance characteristics. The processor 1310 can include any general-purpose processor and a hardware module or software module, such as services (SVC) 1 1332, SVC 2 1334, and SVC 3 1336 stored in the storage device 1330, configured to control the processor 1310 as well as a special-purpose processor where software instructions are incorporated into the actual processor design. The processor 1310 may essentially be a completely self-contained computing system, containing multiple cores or processors, a bus, memory controller, cache, etc. A multi-core processor may be symmetric or asymmetric.

To enable user interaction with the computing system 1300, an input device 1345 can represent any number of input mechanisms, such as a microphone for speech, a touch-protected screen for gesture or graphical input, keyboard, mouse, motion input, speech and so forth. An output device 1335 can also be one or more of a number of output mechanisms known to those of skill in the art. In some instances, multimodal systems can enable a user to provide multiple types of input to communicate with the computing system 1300. The communications interface 1340 can govern and manage the user input and system output. There may be no restriction on operating on any particular hardware arrangement and therefore the basic features here may easily be substituted for improved hardware or firmware arrangements as they are developed.

The storage device 1330 can be a non-volatile memory and can be a hard disk or other types of computer readable media which can store data that are accessible by a computer, such as magnetic cassettes, flash memory cards, solid state memory devices, digital versatile disks, cartridges, random access memory, read only memory, and hybrids thereof.

As discussed above, the storage device 1330 can include the software SVCs 1332, 1334, 1336 for controlling the processor 1310. Other hardware or software modules are contemplated. The storage device 1330 can be connected to the system bus 1305. In some embodiments, a hardware module that performs a particular function can include a software component stored in a computer-readable medium in connection with the necessary hardware components, such as the processor 1310, bus 1305, output device 1335, and so forth, to carry out the function.

FIG. 13B illustrates an example architecture for a chipset computing system 1350 that can be used in accordance with an embodiment. The computing system 1350 can include a processor 1355, representative of any number of physically and/or logically distinct resources capable of executing software, firmware, and hardware configured to perform identified computations. The processor 1355 can communicate with a chipset 1360 that can control input to and output from the processor 1355. In this example, the chipset 1360 can output information to an output device 1365, such as a display, and can read and write information to storage device 1270, which can include magnetic media, solid state media, and other suitable storage media. The chipset 1360 can also read data from and write data to RAM 1375. A bridge 1380 for interfacing with a variety of user interface components 1385 can be provided for interfacing with the chipset 1360. The user interface components 1385 can include a keyboard, a microphone, touch detection and processing circuitry, a pointing device, such as a mouse, and so on. Inputs to the computing system 1350 can come from any of a variety of sources, machine generated and/or human generated.

The chipset 1360 can also interface with one or more communication interfaces 1390 that can have different physical interfaces. The communication interfaces 1390 can include interfaces for wired and wireless LANs, for broadband wireless networks, as well as personal area networks. Some applications of the methods for generating, displaying, and using the technology disclosed herein can include receiving ordered datasets over the physical interface or be generated by the machine itself by the processor 1355 analyzing data stored in the storage device 1370 or the RAM 1375. Further, the computing system 1350 can receive inputs from a user via the user interface components 1385 and execute appropriate functions, such as browsing functions by interpreting these inputs using the processor 1355.

It will be appreciated that computing systems 1300 and 1350 can have more than one processor 1310 and 1355, respectively, or be part of a group or cluster of computing devices networked together to provide greater processing capability.

For clarity of explanation, in some instances the various embodiments may be presented as including individual functional blocks including functional blocks comprising devices, device components, steps or routines in a method embodied in software, or combinations of hardware and software.

Claim language reciting "at least one of" refers to at least one of a set and indicates that one member of the set or multiple members of the set satisfy the claim. For example, claim language reciting "at least one of A and B" means A, B, or A and B.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware, and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

What is claimed:

1. A method of simulating attributes of a stage completion, the method comprising:

determining a first amount of energy used for a stage completion at a first rate during a well completion process;

determining a second rate for simulating the stage completion, the second rate being different than the first rate;

simulating the stage completion at the second rate by determining a second amount of energy used for the stage completion at the second rate; and comparing the first amount of energy to a second amount of energy used in the stage completion to determine a trade-off between energy usage and pumping time.

2. The method of claim 1, wherein determining the first amount of energy used is based on slurry channel data and treating pressure data collected from a wellbore using one or more sensors.

3. The method of claim 2, wherein the first rate is determined based on the slurry channel data and the treating pressure data.

4. The method of claim 1, wherein determining the second amount of energy used comprises:

deriving updated slurry rate data and updated treating pressure data based on the second rate; and determining the second amount of energy using the updated slurry rate data and the updated treating pressure data.

5. The method of 1, further comprising:

identifying one or more data points after simulating the stage completion at the second rate, the one or more data points indicating violation of one or more performance constraints of the well completion process.

6. The method of claim 5, wherein the one or more performance constraints include one or more of a treating pressure threshold, a slurry rate threshold, and a horsepower threshold.

7. The method of claim 6, wherein identifying the one or more data points comprises determining a corresponding binary channel data for each performance constraint, the corresponding binary channel data being equal to one when a corresponding one of the treating pressure threshold, the slurry rate threshold, and the horsepower threshold is violated and zero otherwise.

8. A method of optimizing hydraulic fracturing comprising:

determining a first amount of energy used for a stage completion at a first slurry rate and a first treating pressure during a well completion process;

determining at least one of a second slurry rate and a second treating pressure for simulating the stage completion, the second slurry rate being different than the first slurry rate;

simulating the stage completion at the second slurry rate by determining a second amount of energy used for the stage completion at the second slurry rate; and whereby a new stage is completed using at least one of a slurry rate and a treating pressure based on the second amount of energy used for the stage completion at the second rate.

9. The method of claim 8, further comprising:

identifying one or more data points after simulating the stage completion at the second rate, the one or more data points indicating violation of performance constraints of the well completion process, wherein the new stage is completed using the at least one of the slurry rate and the treating pressure base don the second amount of energy if the one or more data points indicate that the new stage completion using the second amount of energy does not violate the performance constraints.

10. A controller configured to simulate attributes of a stage completion, the controller comprising:

one or more memories having computer-readable instructions stored therein; and one or more processors configured to execute the computer-readable instructions to:

determine a first amount of energy used for a stage completion at a first rate during a well completion process;

determine a second rate for simulating the stage completion, the second rate being different than the first rate;

simulate the stage completion at the second rate by determining a second amount of energy used for the stage completion at the second rate; and compare the first amount of energy to a second amount of energy used in the stage completion to determine a trade-off between energy usage and pumping time.

11. The controller of claim 10, wherein the one or more processors are configured to execute the computer-readable instructions to determine the first amount of energy used based on slurry channel data and treating pressure data collected from a wellbore using one or more sensors.

12. The controller of claim 11, wherein the first rate is determined based on the slurry channel data and the treating pressure data.

13. The controller of claim 10, wherein the one or more processors are configured to execute the computer-readable instructions to determine the second amount of energy used by:

deriving updated slurry rate data and updated treating pressure data based on the second rate; and determining the second amount of energy using the updated slurry rate data and the updated treating pressure data.

14. The controller of claim 10, wherein the one or more processors are configured to execute the computer-readable instructions to identify one or more data points after simulating the stage completion at the second rate, the one or more data points indicating violation of one or more performance constraints of the well completion process.

15. The controller of claim 14, wherein the one or more performance constraints include one or more of a treating pressure threshold, a slurry rate threshold, and a horsepower threshold.

16. The controller of claim 15, wherein the one or more processors are configured to execute the computer-readable instructions to identify the one or more data points by determining a corresponding binary channel data for each performance constraint, the corresponding binary channel data being equal to one when a corresponding one of the treating pressure threshold, the slurry rate threshold, and the horsepower threshold is violated and zero otherwise.

17. One or more non-transitory computer-readable media comprising computer-readable instructions, which when executed by one or more processors of a controller configured to simulate attributes of a stage completion, cause the controller to:

determine a first amount of energy used for a stage completion at a first rate during a well completion process;

determine a second rate for simulating the stage completion, the second rate being different than the first rate;

simulate the stage completion at the second rate by determining a second amount of energy used for the stage completion at the second rate; and compare the first amount of energy to a second amount of energy used in the stage completion to determine a trade-off between energy usage and pumping time.

18. The one or more non-transitory computer-readable media of claim 17, wherein the execution of the computer-readable instructions, further cause the controller to determine the first amount of energy used based on slurry channel data and treating pressure data collected from a wellbore using one or more sensors.

19. The one or more non-transitory computer-readable media of claim 17, wherein the execution of the computer-readable instructions, further cause the controller to determine the second amount of energy used by:

deriving updated slurry rate data and updated treating pressure data based on the second rate; and determining the second amount of energy using the updated slurry rate data and the updated treating pressure data.

20. The one or more non-transitory computer-readable media of claim 17, wherein the execution of the computer-readable instructions, further cause the controller to identify one or more data points after simulating the stage completion at the second rate, the one or more data points indicating violation of one or more performance constraints of the well completion process.

* * * * *